US007364828B2

(12) United States Patent
Yamashita et al.

(10) Patent No.: US 7,364,828 B2
(45) Date of Patent: Apr. 29, 2008

(54) TONER FOR ELECTROPHOTOGRAPHY, METHOD OF MANUFACTURING THE TONER, DEVELOPER, DEVELOPMENT METHOD, TRANSFER METHOD, AND PROCESS CARTRIDGE USING THE TONER

(75) Inventors: Hiroshi Yamashita, Shizuoka (JP); Takuya Saito, Shizuoka (JP); Tsunemi Sugiyama, Shizuoka (JP); Yohichiroh Watanabe, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/328,280

(22) Filed: Jan. 10, 2006

(65) Prior Publication Data

US 2006/0127788 A1 Jun. 15, 2006

Related U.S. Application Data

(62) Division of application No. 10/623,522, filed on Jul. 22, 2003, now Pat. No. 7,074,541.

(30) Foreign Application Priority Data

Jul. 23, 2002 (JP) ..... 2002-214493

(51) Int. Cl.
*G03G 9/087* (2006.01)

(52) U.S. Cl. ..... 430/109.1; 430/105

(58) Field of Classification Search ..... 430/108.1, 430/108.3, 108.4, 109.1, 105
See application file for complete search history.

(56) References Cited

U.S. PATENT DOCUMENTS 5,278,020 A 1/1994 Grushkin et al.
5,290,654 A 3/1994 Sacripante et al.
5,368,972 A * 11/1994 Yamashita et al. ..... 430/137.11
5,429,901 A 7/1995 Muto et al.
5,501,935 A 3/1996 Patel et al.
5,567,566 A 10/1996 Mahabadi et al.
6,248,494 B1 * 6/2001 Yamazaki et al. ..... 430/110.3
6,468,706 B2 10/2002 Matsuda et al.
6,475,691 B1 11/2002 Cheng et al.
6,503,676 B2 1/2003 Yamashita et al.
6,544,704 B1 4/2003 Matsuda et al.
6,753,122 B2 6/2004 Ohmura et al.
6,824,945 B2 11/2004 Emoto et al.

FOREIGN PATENT DOCUMENTS

| | | |
|---|---|---|
| JP | 7-152202 | 6/1995 |
| JP | 11-149179 | 6/1999 |
| WO | WO 02/056116 | 7/2002 |

OTHER PUBLICATIONS

U.S. Appl. No. 11/611,165, Dec. 15, 2006, Sugimoto et al.
U.S. Appl. No. 11/857,999, Sep. 19, 2007, Yamashita et al.

* cited by examiner

*Primary Examiner*—John L Goodrow
(74) *Attorney, Agent, or Firm*—Oblon, Spivak, McClelland, Maier & Neustadt, P.C.

(57) ABSTRACT

The method of manufacturing toner for electrophotography includes the steps of dissolving or dispersing a toner composition containing a resin and a coloring agent into polymerizable monomers to provide a solution or a dispersed system, emulsifying the solution or the dispersed system with a first surface active agent in an aqueous medium to provide an emulsion, and polymerizing the polymerizable monomers in the emulsion to obtain toner. A second surface active agent having polarity opposite to polarity of the first surface active agent is added after the emulsifying step.

16 Claims, No Drawings

TONER FOR ELECTROPHOTOGRAPHY, METHOD OF MANUFACTURING THE TONER, DEVELOPER, DEVELOPMENT METHOD, TRANSFER METHOD, AND PROCESS CARTRIDGE USING THE TONER

BACKGROUND OF THE INVENTION

1. Field of the Invention

The present invention relates to toner used in developer for developing an electrostatic latent image in electrophotography, electrostatic recording, electrostatic printing, etc., a method of manufacturing the toner, and a process cartridge that contains the toner. More particularly, the present invention relates to toner for electrophotography used in a copying machine, a laser printer, and a fax machine for normal paper, which use a direct or indirect electrophotographic developing process, a method for manufacturing the toner, and a process cartridge that contains the toner. Moreover, the present invention relates to toner for electrophotography used in a full-color copying machine, a full-color laser printer, and a full-color fax machine for normal paper, which use a direct or indirect electrophotographic multi-color image developing process, a method for manufacturing the toner, a method for developing the toner, and a process cartridge that contains the toner.

2. Description of the Related Art

Developer used in electrophotography, electrostatic recording, electrostatic printing, etc., first adheres to an image supporter such as a photoconductor on which an electrostatic latent image is formed in a development process, then is transferred from the photoconductor to a transfer medium such as a piece of transfer paper in a transfer process, and subsequently is fixed on the surface of the transfer medium in a fixing process. Herein, a two-component developer containing carrier and toner and a one-component developer requiring no carrier (magnetic toner, non_magnetic toner) are known as developers for developing an electrostatic latent image formed on a latent image-supporting surface.

Conventionally, dry-type toner used in electrophotography, electrostatic recording, and electrostatic printing is obtained by melting and kneading a toner binder such as a styrene-based resin and a polyester, etc., with a coloring agent and by milling the obtained material.

Image quality has been improved in recent times, by reducing particle diameter of the toner. However, in the manufacturing process including normal kneading and milling, the shape of the toner particle is undefined. Also, the toner particle size is further reduced by agitation with carriers in the development part inside of an image forming apparatus, and contact stress between a development roller and a toner feeding roller and between a blade for controlling the thickness of a toner layer and a blade for frictional electrification of the photoconductor, etc., in the case of using toner as the developer in a one-component system. As a result, the image quality is lowered by formation of extremely fine particles and by the embedding of a fluidizing agent into the surface of the toner. Additionally, the fluidity of the toner as powder is reduced due to the undefined shape of the toner particles so that much energy for fluidization is required and a filling factor of putting the toner in a toner bottle is so low that miniaturization of the toner bottle cannot be sufficiently achieved. Accordingly, further reducing the particle diameter is not effective at present. Also, the presently achievable minimum of the particle diameter is being produced in the conventional milling process, so that further miniaturization of the particle diameter cannot be achieved.

Moreover, in order to create a full-color image, a transfer process for a color image created with multi-color toners from a photoconductor to a transfer medium or paper is conventionally complicated. Also, a defect in the transferred image occurs due to the deterioration of the transfer property caused by the undefined shape of the milled toner particles and the amount of the toner consumed becomes large in order to cover the defect in the transferred image. Accordingly, reducing the amount of consumption of the toner by further improvement of transfer efficiency is desired so as to obtain a high-grade image with no defects and reduce the running cost of image formation. If the transfer efficiency is very high, a cleaning unit for eliminating un-transferred toner from the surface of the photoconductor is not needed, and the advantages of miniaturization of the machine, reduction of the cost for image formation, and elimination of wasted toner can be simultaneously achieved. In order to compensate for the disadvantages of such effect of the undefined shape, various methods for manufacturing spherical toner particles have been studied.

As a method for solving those problems, methods of manufacturing toner by utilizing a suspension polymerization process and an emulsion polymerization aggregation process have been studied. Additionally, in Japanese Laid-Open Patent Application No. 7-152202, a method utilizing volume shrinkage is studied, which is called the polymer dissolution or suspension method. The method includes the steps of dispersing or dissolving a toner material into a volatile solvent such as an organic solvent with a low melting point to obtain a dispersed system or a solution, emulsifying the dispersed system or the solution in an aqueous medium that contains a dispersing agent to form droplets, and subsequently eliminating the volatile solvent from the dispersed system or the solution. The method is different from both the suspension polymerization method and the emulsion polymerization aggregation method, and many kinds of resins are available. In particular, the method has an advantage of employing a polyester resin useful for a full-color process that is required to provide enough transparency and enough smoothness to image parts after fixing. However, since used dispersing agent strongly adheres to the surface of the toner particles, elimination of the dispersing agent is difficult even by a subsequent washing process and the electrostatic property of the toner is strongly dominated by the used dispersing agent. Accordingly, average charge level of the obtained toner is low, charging speed for the toner is slow, and the toner is strongly affected by humidity.

Additionally, in Japanese Laid-Open Patent Application No. 11-149179, low-molecular resin is used for the polymer dissolving or suspending process so as to reduce the viscosity of a dispersion phase in the solution or dispersed system, to facilitate the emulsification, and to cause polymerization reaction inside the particles for improving the fixing property. However, the influence of a functional group used for the polymerization reaction inside the particles cannot be negligible. Particularly, in the case of employing an isocyanate compound, the fixing property of the toner is strongly dominated by the electrostatic property of an obtained urethane or urea group as well as the aforementioned influence of the dispersing agent.

Additionally, although it has been attempted to make a dry-type charge control agent adhere and become fixed to the surface of such obtained particles, the fixation of the toner is disturbed in many cases, so that the problem of the antinomy phenomenon of provision of electric charge to the toner and low-fixation temperature of the toner has not been solved.

SUMMARY OF THE INVENTION

It is one object of the present invention to reduce the influence of a dispersing agent and a chemical compound used for the polymerization reaction in the suspension polymerization method, the emulsification polymerization aggregation method, and the polymer suspension method on the electrostatic property of toner and to obtain the necessary electrostatic property of the toner.

Another object of the present invention is to provide toner having a high average charge level and high charging speed, which is not influenced by the temperature and the humidity, and a method of manufacturing the toner.

Another object of the present invention is to provide toner having a narrow particle size distribution, the particles being in the shape of a sphere, and having a wide fixing property and a melt viscosity caused by the presence of a polymer component.

Another object of the present invention is to reproduce a high quality full-color image by developing a latent image accurately.

Another object of the present invention is to reproduce a high quality full-color image with high transfer efficiency.

Another object of the present invention is to provide a process cartridge including the above-mentioned toner.

The objects described above are achieved by a method of manufacturing toner for electrophotography, including the steps of dissolving or dispersing a toner composition containing a resin and a coloring agent into polymerizable monomers to provide a solution or a dispersed system, emulsifying the solution or the dispersed system with a first surface active agent in an aqueous medium to provide an emulsion, and polymerizing the polymerizable monomers in the emulsion to obtain toner, wherein a second surface active agent having polarity opposite to polarity of the first surface active agent is added after the emulsifying step.

The objects described above are achieved by a method of manufacturing toner for electrophotography, including the steps of dispersing a toner composition containing a resin and a coloring agent into an aqueous medium to provide a dispersed system, aggregating the dispersed system in an aqueous medium containing a first surface active agent to provide an aggregate, and fusing the aggregate by heating to obtain toner, wherein a second surface active agent having polarity opposite to polarity of the first surface active agent is added after the fusing step.

The objects described above are achieved by a method of manufacturing toner for electrophotography, including the steps of dissolving or dispersing a toner composition containing a resin and a coloring agent into an organic solvent to provide a solution or a dispersed system, emulsifying the solution or the dispersed system with a first surface active agent in an aqueous medium to provide an emulsion, and eliminating the organic solvent from the emulsion to obtain toner, wherein a second surface active agent having polarity opposite to polarity of the first surface active agent is added after the emulsifying step.

The objects described above are achieved by a method of manufacturing toner for electrophotography, including the steps of dissolving or dispersing a toner composition containing a resin, a coloring agent, and polymerizable monomers into an organic solvent to provide a solution or a dispersed system, emulsifying the solution or the dispersed system with a first surface active agent in an aqueous medium to provide an emulsion, polymerizing the polymerizable monomers in the emulsion to obtain a polymer liquid, and eliminating the organic solvent from the polymer liquid to obtain toner, wherein a second surface active agent having polarity opposite to polarity of the first surface active agent is added after the emulsifying step.

The objects described above are achieved by a method of manufacturing toner for electrophotography, including the steps of dissolving or dispersing a toner composition containing a resin and a coloring agent into polymerizable monomers to provide a solution or a dispersed system, emulsifying the solution or the dispersed system with a first surface active agent in an aqueous medium to provide an emulsion, and polymerizing the polymerizable monomers in the emulsion to obtain toner, wherein a second surface active agent having polarity opposite to polarity of the first surface active agent and a charge control agent are added after the emulsifying step.

The objects described above are achieved by a method of manufacturing toner for electrophotography, including the steps of dispersing a toner composition containing a resin and a coloring agent into an aqueous medium to provide a dispersed system, aggregating the dispersed system in an aqueous medium containing a first surface active agent to provide an aggregate, and fusing the aggregate by heating to obtain toner, wherein a second surface active agent having polarity opposite to polarity of the first surface active agent and a charge control agent are added after the fusing step.

The objects described above are achieved by a method of manufacturing toner for electrophotography, including the steps of dissolving or dispersing a toner composition containing a resin and a coloring agent into an organic solvent to provide a solution or a dispersed system, emulsifying the solution or the dispersed system with a first surface active agent in an aqueous medium to provide an emulsion, and eliminating the organic solvent from the emulsion to obtain toner, wherein a second surface active agent having polarity opposite to polarity of the first surface active agent and a charge control agent are added after the emulsifying step.

The objects described above are achieved by a method of manufacturing toner for electrophotography, including the steps of dissolving or dispersing a toner composition containing a resin and a coloring agent and polymerizable monomers into an organic solvent to provide a solution or a dispersed system, emulsifying the solution or the dispersed system with a first surface active agent in an aqueous medium to provide an emulsion, polymerizing the polymerizable monomers in the emulsion to obtain a polymer liquid, eliminating the organic solvent from the polymer liquid to obtain toner, wherein a second surface active agent having polarity opposite to polarity of the first surface active agent and a charge control agent are added after the emulsifying step.

Preferably, in the method of manufacturing toner for electrophotography described above, the polymerizable monomer containes a compound having an isocyanate group at a terminal thereof.

Preferably, in the method of manufacturing toner for electrophotography described above, the second surface active agent having polarity opposite to polarity of the first surface active agent is a fluorine-atom containing a surface active agent.

Preferably, in the method of manufacturing toner for electrophotography described above, the fluorine-atom containing surface active agent is a cationic surface active agent containing a perfluoroalkyl group.

Preferably, in the method of manufacturing toner for electrophotography described above, the second surface active agent having polarity opposite to polarity of the first surface active agent is a chemical compound represented by the general formula:

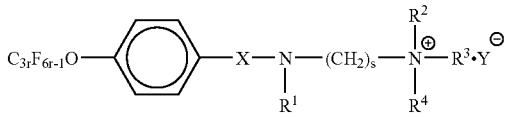

wherein X is one of —$SO_2$— and —CO—, each of R1, R2, R3, and R4 is one of a hydrogen atom, a lower alkyl group containing 1 through 10 carbon atoms, and an aryl group, Y is one of I and Br, and each of r and s is an integer of 1 through 20.

Preferably, in the method of manufacturing toner for electrophotography described above, heating is performed after the second surface active agent having polarity opposite to polarity of the first surface active agent is added or after the second surface active agent having polarity opposite to polarity of the first surface active agent and the charge control agent are added.

Preferably, in the method of manufacturing toner for electrophotography described above, the charge control agent is a charge control agent dispersed in an aqueous medium previously.

Preferably, in the method of manufacturing toner for electrophotography described above, the charge control agent is calixarene and polymer thereof.

Preferably, in the method of manufacturing toner for electrophotography described above, the charge control agent is a metal salt or a metal complex of a salicylic acid derivative.

Preferably, in the method of manufacturing toner for electrophotography described above, the charge control agent is a fine resin particle.

Preferably, in the method of manufacturing toner for electrophotography described above, the fine resin particle contains a fluorine-containing compound.

Preferably, in the method of manufacturing toner for electrophotography described above, the fine resin particle is obtained by emulsion polymerization.

Preferably, in the method of manufacturing toner for electrophotography described above, the fine resin particle is obtained by copolymerization of at least styrene and methacrylic acid.

The objects described above are achieved by toner for electrophotography obtained by using the method of manufacturing toner for electrophotography described above.

The objects described above are achieved by developer for electrophotography containing a toner for electrophotography described above and a carrier for carrying the toner.

The objects described above are achieved by a development method of developing electrostatic latent images for respective colors independently formed on a single photoconductor with corresponding developers for the respective colors using a plurality of development devices having a development roller and a development blade for controlling the thickness of a layer of developer provided on the development roller to be uniform, wherein the developers are the toners for electrophotography described above or the developers for electrophotography described above.

The objects described above are achieved by a transfer method of transferring to an intermediate transfer medium with an electric field an image developed by developing electrostatic latent images for respective colors independently formed on a single photoconductor with corresponding developers for the respective colors using a plurality of development devices having a development roller and a development blade for controlling the thickness of a layer of developer provided on the development roller to be uniform, wherein the developers are the toners for electrophotography described above or the developers for electrophotography described above.

The objects described above are achieved by a development method of developing electrostatic latent images for respective colors independently formed on a plurality of photoconductors corresponding to a plurality of development devices having a development roller and a development blade for controlling the thickness of a layer of developer provided on the development roller to be uniform, with corresponding developers for the respective colors using the development devices, wherein the developers are the toners for electrophotography described above or the developers for electrophotography described above.

The objects described above are achieved by a transfer method of transferring to an intermediate transfer medium with electric field an image developed by developing electrostatic latent images for respective colors independently formed on a plurality of photoconductors corresponding to a plurality of development devices having a development roller and a development blade for controlling the thickness of a layer of developer provided on the development roller to be uniform, with corresponding developers for the respective colors using the development devices, wherein the developers are the toners for electrophotography described above or the developers for electrophotography described above.

The objects described above are achieved by a process cartridge removable from a main body of an image forming apparatus, including as one unit at least one of a latent image supporter, a charging unit charging a surface of the latent image supporter, a packaging unit packaging the toner for electrophotography described above or developers for electrophotography described above, a development unit developing a latent image formed on the latent image supporter with the toner or the developer, and a cleaning unit cleaning the toner or the developer remaining on the latent image supporter.

DETAILED DESCRIPTION OF THE PREFERRED EMBODIMENTS

The present invention is illustrated in detail below.

In the present invention, since a polymerizable monomer and an organic solvent are employed, particularly, when a first surface active agent present in an aqueous medium has high affinity with the polymerizable monomer and/or the organic solvent, the first surface active agent tends to remain on the surface of a toner particle. Also, in respect to the emulsification polymerization aggregation process, when an obtained aggregate is fused, the first surface active agent tends to remain inside the toner particle. Accordingly, a second surface active agent having polarity opposite to the polarity of the used first surface active agent is added after the formation of the toner particle and the remaining first surface active agent is adsorbed preferentially to the second surface active agent, so as to eliminate the influence of the remaining first surface active agent.

In particular, in the polymer suspension method, a low molecular resin is employed to lower the viscosity of a dispersed system (an oil phase) and to facilitate emulsification, and after the emulsification, a particle that contains a polymeric resin can be created by addition polymerization reaction inside the particle. However, the polymer obtained by the addition polymerization reaction significantly influences the electrostatic property of the toner. Herein, the influence of the residual first surface active agent on the electrostatic property of the polymer obtained via the addition polymerization reaction can be reduced by reacting the second surface active agent having polarity opposite to the polarity of the used first surface active agent to the toner particle and adsorbing the residual first surface active agent preferentially. Accordingly, spherical particles having a smooth surface, narrow particle size distribution, and low fixing temperature, which seldom adhere to a fixing roller or belt can be obtained.

Additionally, when toner is formed using a fluorine-atom containing surface active agent as the second surface active agent, the charging speed of the toner can be significantly raised and the stability of charge on the toner can be maintained under high temperature and high humidity even when the amount of the second surface active agent is very little. Among the fluorine-atom containing surface active agents, a particular cationic surface active agent is useful.

Additionally, when the second surface active agent is added after the formation of the toner particle, a charge control agent is added together with the second surface active agent and both the charge control agent and the second surface active agent adhere to the surface of the toner particle so as to raise the charge level of the toner particle and maintain the raised charge level.

For example, a dispersed particle obtained by dispersing a charge control agent in an aqueous medium is prepared, which size (preferably equal to or less than 1 μm) is much smaller than the size of the toner particle, and the second surface active agent is applied to the dispersed particle after the formation of the toner particle, so that the fine particles containing the charge control agent can uniformly adhere to the surface of the toner particle while the second surface active agent can be adsorbed to the toner particle. Preferably, the charge of the dispersed particles containing the charge control agent in the aqueous medium is the same as the charge of the toner particles obtained after emulsification for uniform adhesion of the charge control agent.

Preferably, the charge control agent may be a fine resin particle. In particular, when the fine resin particle is an emulsified polymer of the resin, since the emulsified polymer disperses stably and finely, the emulsified polymer itself can be used. Particularly, the fine resin particle in which a fluorine atom-containing compound is compounded or copolymerized or both styrene and methacrylic acid are employed as monomers is excellent in the electrostatic property of the charge control agent.

The toner manufactured as described above can provide a high quality image by a method of repeating development and transferring using a single photoconductor or by a process for creating a full-color image using photoconductors and development devices for respective colors, that is, development and transfer by a so-called tandem method.

Additionally, an intermediate transfer method has an advantage of being able to suppress color shift, and the problems of image deterioration caused by multiple transfers and increase of residual toner after transfer can be solved using the toner according to the present invention.

Additionally, the present invention provides a process cartridge removable from the main body of an image forming apparatus, including as one unit, at least one selected from a group including a latent image supporter (photoconductor), a charging unit for charging a surface of the latent image supporter, a packaging unit for packaging toners or developers for electrophotography according to the present invention, a development unit for developing a latent image formed on the latent image supporter with the developer, and a cleaning unit of cleaning the developer remaining on the latent image supporter.

Next, a polymer, a surface active agent, and others used in the manufacture of the toner according to the present invention are illustrated below.

(Suspension Polymerization Method)

A coloring agent and a release agent, etc., are dispersed in a oil-soluble polymerization initiator and a polymerizable monomer to obtain a dispersed system and the dispersed system is emulsified in an aqueous medium that contains a first surface active agent and a solid dispersing agent, etc., using an emulsification method mentioned below. Then, after particles are formed by polymerization reaction, the charge control treatment according to the present invention is performed.

(Emulsification Polymerization Aggregation Method)

A water-soluble polymerization initiator and a polymerizable monomer are emulsified with a surface active agent in water and a latex is synthesized by the normal emulsification polymerization method. Separately, a dispersed system is prepared by dispersing a coloring agent and a release agent in an aqueous medium. After the latex and the dispersed system are mixed together, the obtained mixture is aggregated to toner particle size and the obtained aggregate is fused by heating so as to obtain toner. Then, the obtained toner is treated with a charge control agent.

(Polymer Suspension Method)

The aqueous medium used in the present invention may be only water or the combination of water and a solvent miscible with water. As the solvent miscible with water, provided are alcohols (such as methanol, isopropanol, and ethylene glycol, etc.), dimethylformamide, tetrahydrofuran, cellosolves (such as methylcellosolve, etc.), and lower ketones (such as acetone, and ethyl methyl ketone, etc.).

In the oil phase of a toner composition, a resin, a prepolymer, a coloring agent such as a pigment, etc., a release agent, and a charge control agent are dispersed into a volatile solvent. In order to lower the viscosity of the oil phase, accordingly, to enable the toner composition to be emulsified, a volatile solvent in which a polyester resin and the prepolymer are soluble is used. A volatile solvent having boiling point lower than 100° C. is preferable since such a volatile solvent is easily eliminated.

As the volatile solvent, for example, toluene, xylene, benzene, carbon tetrachloride, methylene dichloride, 1,2-dichloroethane, 1,1,2-trichloroethane, trichloroethylene, chloroform, monochlorobenzene, dichloroethylidene, methyl acetate, ethyl acetate, ethyl methyl ketone, and isobutyl methyl ketone can be used independently or in combination. Particularly, an aromatic solvent such as toluene and xylene, etc., and a halogenated hydrocarbon such as methylene dichloride, 1,2-dichloroethane, chloroform, and carbon tetrachloride, etc., are preferable. The shape of a toner particle is further controlled using a solvent soluble in an aqueous medium such as other alcohols and water, etc., in combination.

The usage of the solvent per 100 parts of the toner composition is commonly 10 through 900 parts.

The toner particle may be formed by reacting a dispersed system obtained by dispersing, for example, a prepolymer having an isocyanate group and another toner composition in a volatile organic solvent, with an amine in an aqueous medium. As the method of stably forming the dispersed system containing the prepolymer and the toner composition in the aqueous system, provided is a method including the steps of adding a composition of a toner material containing the prepolymer to the aqueous medium and dispersing the particle of the composition produced by using shearing force.

The prepolymer and another toner composition component that contains a coloring agent, a coloring agent master batch, a release agent, a charge control agent, and a polyester resin, etc. (referred to as toner materials, below), may be mixed together when a dispersed system is prepared in an aqueous medium. More preferably, after the toner materials are previously mixed together to prepare an oil phase, the obtained mixture is added and dispersed to the aqueous medium.

For the dispersion, a mixer with a normal agitation device is used, more preferably, a dispersing machine using one of media such as a homogenizer having a high-speed rotator and a stirrer, a high-pressure homogenizer, as well as boll mill, beads mill, and sand mill.

Also, in the present invention, other toner materials such as a coloring agent, a release agent, and a charge control agent do not need to be mixed until a toner particle is formed in an aqueous medium, and after the formation of the toner particle, the toner materials may be added to the aqueous medium. For example, after a toner particle containing no coloring agent is created, the coloring agent may be added using the well known dying method.

The method for the dispersion is not limited, and preferably, well known equipment such as a low-speed shearing type, a high-speed shearing type, a friction type, a high-pressure jet type, and an ultrasound-type are available. The high-speed shearing type is preferable in order to control the size of a dispersed particle to be 2 through 20 μm. As an emulsifying machine having a rotating blade is not limited, an emulsifying machine and a dispersing machine placed on the market (generally available) can be used.

For example, provided are continuous emulsifiers such as Ultra Turrax (available from IKA Company), Polytron (available from Kinematica), TK Auto Homo Mixer (available from Tokushu Kika Kogyo Co., Ltd.), Ebara Milder (available from Ebara Corporation), TK Pipeline Homo Mixer, TK Homomic Line Flow (available from Tokushu Kika Kogyo Co., Ltd.), Colloid Mill (available from Shinko Pantec Co., Ltd.), Slasher, Trigonal wet-type mill (available from Mitsui Miike Machinery Co., Ltd.), Cavitron (available from Eurotec Industries, Ltd.), and Fainfuromir (available from Pacific Machinery & Engineering Co., Ltd.), and batch or continuous double emulsifiers such as Clear Mix (available from M Technique Co., Ltd.) and Fillmix (available from Tokushu Kika Kogyo Co., Ltd.).

When a high-speed shearing dispersing machine is used, the rotational speed is not limited, but is commonly 100 through 30,000 rpm, more preferably 5,000 through 20,000 rpm. The dispersing time is not limited but is commonly 0.1 through 5 minutes in the case of a batch type. The temperature at time of dispersion is commonly 0 through 150° C. (under the application of pressure), preferably 10 through 98° C. High temperature is preferable since the viscosity of the dispersed system containing the prepolymer and the toner materials is low and the dispersion easily occurs.

The usage of the aqueous medium per 100 parts of the toner composition that contains the prepolymer is commonly 50 through 2,000 parts by weight, preferably 100 through 1,000 parts by weight. When the usage is less than 50 parts by weight, the dispersion condition of the toner composition is not good, and toner particles having a predetermined size cannot be obtained. On the other hand, when the usage is over 20,000 parts by weight, this method of manufacturing toner is not economical.

Also, solid fine particles as a dispersing agent as well as a surface active agent as an emulsion stabilizer may be dispersed in the aqueous medium. Additionally, stabilization of droplets of a dispersed system may be adjusted with a polymeric protective colloid. For example, a homopolymer and a copolymer can be used which are provided by polymerizing monomers selected from the group including acids such as acrylic acid, methacrylic acid, α-cyanoacrylic acid, α-cyanomethacrylic acid, itaconic acid, crotonic acid, fumaric acid, maleic acid, and maleic anhydride, meth (acrylic) monomer containing a hydroxyl group, esters such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, monoester of diethylene glycol and acrylic acid, monoester of diethylene glycol and methacrylic acid, monoester of glycerine and acrylic acid, and monoester of glycerine and methacrylic acid, amides such as N-methylol acrylamide, and N-methylol methacrylamide, vinyl alcohol, ethers derived from vinyl alcohol such as methyl vinyl ether, ethyl vinyl ether, and propyl vinyl ether, esters derived from vinyl alcohol and carboxylic acid such as vinyl acetate, vinyl propionate, and vinyl butyrate, amides such as acrylammide, methacrylamide, and diacetone acrylamide, and methyrol compounds with the amide, carbonyl chlorides such as acryloyl chloride and methacryloyl chloride, a compound that contains a nitrogen atom or heterocyclic ring containing a nitrogen atom such as vinyl pyridine, vinyl pyrolidone, vinyl imidazole, and ethylene imine. Additionally, poly (oxyethylene)-based compounds such as poly(oxyethylene), poly(oxypropylene), poly(oxyethylenealkylamine), poly (oxypropylenealkylamine), poly(oxyethylenealkylamide), poly(oxypropylenealkylamide), poly(oxyethylenenonylphenylether), poly(oxyethylenelaurylphenylether), poly(oxyethylenestearylphenylester), poly(oxyethylenenonylphenylester) and celluloses such as methylcellulose, hydroxyethylcellulose, and hydroxypropylcellulose can also be used.

When the dispersing agent is used, the dispersing agent may remain on the surface of the toner particle. However, after propagation and/or crosslinking reaction, preferably, the residual dispersing agent of the solid fine particles should be eliminated by dissolution washing for charging of the toner.

The reaction time of the propagation and/or crosslinking reaction depends on the reactivity between the prepolymer containing an isocyanate group (A) and the amine (B), and is commonly 20 through 40 hours, preferably 2 through 24 hours. The reaction temperature is commonly 0 through 150° C., preferably 40 through 98° C. Also, a well-known catalyst may be used according to necessity. Specifically, diobutyl tin laurate and dioctyl tin laurate, etc., are listed.

In order to eliminate the organic solvent from the obtained emulsion, a method of raising the temperature of the emulsion gradually so as to evaporate the organic solvent in the droplets of the emulsion completely may be employed. Alternatively, a method of spraying the emulsion into a dried atmosphere so as to eliminate non-water-soluble organic solvent in the droplets of the emulsion and to form toner fine particles as well as evaporating an aqueous dispersing agent, can be employed. For the dried atmosphere, in which the emulsion is sprayed out, generally used are air, nitrogen, carbon dioxide, and combustion gas, etc., that are heated, particularly, each kind of gas heated to a temperature equal to or greater than the boiling point of a solvent having the highest boiling point among those of the organic solvents. The heated gas with the objective quality can be obtained by short duration treatment using a spray drier, a belt drier, and a rotary kiln, etc.

Where the particle size distribution in the emulsion is broad and washing and drying treatment is performed while the particle size distribution is maintained, the dispersed particles can be classified to the desired particle size distribution to control the particle distribution.

The classification procedure may be performed in the emulsion by one of cyclone, decantation, and centrifugation, etc., so that finer particles are removed. Of course, the classification procedure may be performed after the toner particles are dried to obtain powder. However, the classification procedure is preferably performed in the emulsion for the efficiency of the classification. Obtained unwanted finer particles and/or courser particles can be brought back to the kneading process to be used in the formation of the particles. Herein, the finer particles and coarser particles may be wet.

Preferably, the used dispersing agent should be removed from the dispersed system as much as possible, and more preferably, the dispersing agent is removed at the same time of the classification procedure.

The obtained dried toner powder is mixed with at least one kind of fine particles selected from the group including the fine particles of a release agent, a charge control agent, a fluidizing agent, and a coloring agent, etc., and if necessary, mechanical impact force is applied to the mixed powder so as to fix the fine particles on the surface of the toner powder (particles) and fuse them for obtaining composite powder. Thus, the fine particles can be prevented from escaping from the surface of the obtained composite powder.

Specifically, provided are a method of applying impact force to the mixture by using a blade that rotates at high speed and a method of throwing the mixture into a high speed gas flow so that the mixture is accelerated and both the toner particles and the fine particles or the composite particles collide with an appropriate collision plate. As apparatuses for implementing the methods, provided are Angmill (available from Hosokawa Micron Corporation) and I-type mill (available from Nippon Pneumatic Mfg. Co., Ltd.) that are adapted to drop air pressure for milling Hybridization System (available from Nara Machinery Co., Ltd.), Kryptron System (available from Kawasaki Heavy Industries, Ltd.), and an automatic mortar, etc.

(Surface Treatment Method)

In all the methods of manufacturing toner, surface treatment with the charge control agent may be performed in liquid. Preferably, after the toner particles are formed and then the used first surface active agent is washed out, the surface treatment is performed. The residual first active agent present in water is eliminated by a solid-liquid separation method such as filtration and centrifugation and the obtained cake and/or slurry is re-dispersed in an aqueous medium. After that, a solution of the second surface active agent is added gradually with stirring. Herein, 0.01 through 1% by weight of the second surface active agent per solid contents of the toner particles may be used.

Also, for the purpose of compensating the electrostatic property, a dispersed system containing fine particles of the charge control agent may be provided in re-dispersed slurry. The charge control agent is commonly in the form of a powder, but the dispersed system containing fine particles can be obtained by dispersing the dispersing agent in an aqueous medium using the first surface active agent used for forming particles in the aqueous medium and the second surface active agent having polarity opposite to the polarity of the first active agent added for the purpose of providing the electrostatic property to the particles. Due to addition of the second surface active agent, the charge of the dispersed system of the fine particles of the charge control agent is neutralized in water, so that the charge control agent can be aggregated and adheres to the surface of the toner particles. Preferably, the charge control agent should be dispersed particles having a particle diameter of 0.01 through 1 μm. Additionally, 0.01 through 5% by weight of the charge control agent relative to solid content of the toner particles may be used.

Also, for the purpose of compensating the electrostatic property, a dispersed system containing fine particles of the resin may be provided in re-dispersed slurry. Preferably, the dispersed system containing fine particles of the resin is obtained by the means of the combination of emulsification and polymerization. Due to addition of the second surface active agent, the charge of the dispersed system of the fine particles of the resin is neutralized in water, so that the resin can be aggregated and adheres to the surface of the toner particles. Additionally, 0.01 through 5% by weight of the fine particles of the resin relative to solid content of the toner particles may be used.

The fine particles of the charge control agents or the fine particles of the resin adhered to the surface of the toner are fixed to the surface of the toner by heating the slurry so that the fine particles can be prevented from escaping from the toner surface. Then, it is preferable to heat the slurry to a temperature higher than Tg of the resin contained in the toner.

(Charge Control Agent)

Any of well-known charge control agents can be used, for example, nigrosine-based dyes, triphenylmethane-based dyes, chromium-containing metal complex dyes, molybdate ion chelate pigments, rhodamine-based dyes, alkoxy amines, quaternary ammonium salts (including fluorine-modified quaternary ammonium salts), alkylamides, chemical elements or compounds of phosphorus, chemical elements or compounds of tungsten, fluorine-based activators, metal salts of salicylic acid, and metal salts of salicylic acid derivatives, etc. Specifically, provided are Bontron 03 as a nigrosine-based dye, Bontron P-51 as a quaternary ammonium salt, Bontron S-34 as a metal-containing azo dye, E-82 as an oxynaphthoic acid-based metal complex, E-84 as a salicylic acid-based metal complex, E-89 as a phenol-based condensate (available from Orient Chemical Industries, Ltd.), TP-32 and TP-415 as complexes of quaternary ammonium ion and molybdenum ion (available from Hodogaya Chemical Co., Ltd.), Copy Charge PSY VS2038 as a quaternary ammonium salt, Copy Blue PR as a triphenylmethane derivative, Copy Charge NEG VP2036 as a quaternary ammonium salt, Copy Charge NX VP434 (available from Heachest Company), LRA-901, LR-147 as a boron complex (available from Japan Carlit Co., Ltd.), copper phthalocyanine, perylene, quinacridone, azo pigments, and polymeric compounds having a functional group of a sulfonic group, a carboxyl group, or a quaternary ammonium group.

(Charge Control Resin Fine Particles)

As a charge control resin fine particles, polymeric particles such as a dispersed system containing fine particles and resin, which is obtained by soap-free emulsification polymerization, suspension polymerization, or dispersion polymerization are preferable. Particularly, provided are polymeric fine particles formed from a material selected from the group including a copolymer obtained by copolymerization of styrene and a monomer having a carboxyl group such as methacrylic acid, a copolymer obtained by copolymerization of an ester derived from a fluorine-containing methacrylic acid and an ester derived from a fluorine-containing acrylic acid in the emulsification polymerization or the dispersion polymerization, condensation-polymerized polymers such as silicone, benzoguanamine, and nylon, and thermosetting resin.

(Surface Active Agent)

As an anionic surface active agent, alkylbenzenesulfonic acid, α-olefinsulfonic acid, and an ester of phosphoric acid are provided.

As a cationic surface active agent, provided are alkylamine salts, amyl alcohol-fatty acid derivatives, polyamine-fatty acid derivatives, amine salts such as imidazoline, alkyltrimethylammonium salts, dialkyldimethylammonium salts, alkyldimethylbenzylammonium salts, pyridinium salts, allkylisoquinolinium salts, and quaternary ammonium salts such as benzethonium chloride.

Additionally, in combination with those surface active agents, a non-ionic surface active agent such as fatty amide derivatives and polyalcohol derivatives, and amphoteric surface active agents such as alanine, dodecyl(aminoethyl) glycin, di(octylaminoethyl)glycin and N-alkyl-N,N-dimethylammonium betaine may be used.

The usage of the surface active agent per the entire water phase is preferably 0.1 through 10% by weight.

In the present invention, the electrostatic property and the initial electrostatic property of the toner particle can be improved by using a fluorine-containing surface active agent as the second surface active agent having polarity opposite to the polarity of the first surface active agent.

As a preferably used anionic surface active agent having a fluoroalkyl group, provided are C2 through C10 (2 through 10 carbon atoms-containing) fluoroalkylcarboxylic acids and metal salts thereof, disodium perfluorooctanesulfonylglutamate, sodium 3-[omega-fluoroalkyl(C6 through C11) oxy]-1-alkyl(C3 through C4) sulfonates, sodium 3-[omega-fluoroalkanoyl(C6 through C8)-N-ethylamino]-1-propanesulfonates, fluoroalkyl(C11 through C20) carboxylic acids and metal salts thereof, perfluoroalkylcarboxylic acids (C7 through C13) and metal salts thereof, perfluoroalkyl(C4 through C12)sulfonic acids and metal salts thereof, diethanolamide of perfluorooctanesulfonic acid, N-propyl-N-(2-hydroxyethyl)perfluorooctanesulfonamide, perfluoroalkyl(C6 through C10)sulfonamide propyltrimethylammonoum salts, salts of perfluoroalkyl(C6 through C10)-N-ethylsulfonylglycines, and esters of monoperfluoroalkyl(C6 through C16)ethylphosphoric acids.

As designated by specific commercial names, provided are Surflon S-111, S-112, S-113 (available from Asahi Glass Company), Florad FC-93, FC-95, FC-98, FC-129 (available from Sumitomo 3M Co., Ltd.), Unidyne DS-101, DS-102 (available from Daikin Industries, Ltd.), Megaface F-110, F-120, F-113, F-191, F-812, F-833 (available from Dainippon Ink and Chemicals, Inc.), Ektop EF-102, 103, 104, 105, 112, 123A, 123B, 306A, 501, 201, 204 (available from Tokem products), and Ftergent F-100, F-150 (available from Neos Co., Ltd.).

As a cationic surface active agent, provided are aliphatic primary, secondary, and tertiary amines, aliphatic quaternary ammonium salts such as perfluoroalkyl(C6 through C10) sulfonamidepropyltrimmethylammonium salts, benzalkonium salts, benzethonium chloride, pyridinium salts, and imidazolinium salts. As designated by commercial names, there are Surflon S-121 (available from Asahi Glass Company), Florad FC-135 (available from Sumitomo 3M Co., Ltd.), Unidyne DS-202 (available from Daikin Industries, Ltd.), Megaface F-150, F-824 (available from Dainippon Ink and Chemicals, Inc.), Ektop EF-132 (available from Tokem products), and Ftergent F-300 (available from Neos Co., Ltd.).

Particularly, a stable developer with small change of charge at the time of the variation of environment by using fluorine-containing quaternary ammonium salt compounds represented by the general formula (I):

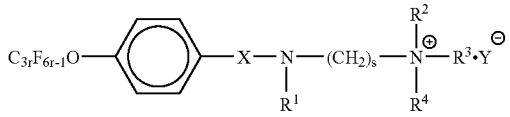

wherein X is —SO2— or —CO—, each of R1, R2, R3, and R4 is selected from the group including a hydrogen atom, lower alkyl groups containing 1 through 10 carbon atoms and aryl groups, Y is I or Br, each of r and s is an integer of 1 through 20.

Specifically, the developer may be compounds represented by the structural formulas 1) through 54) as follows:

1)

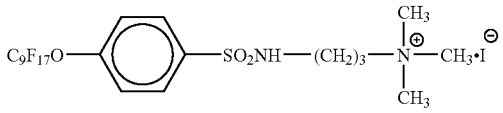

2)

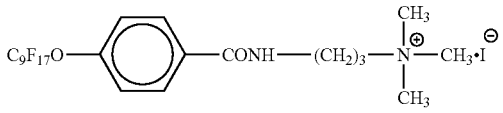

3)

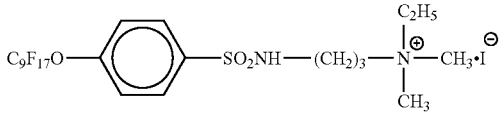

4)

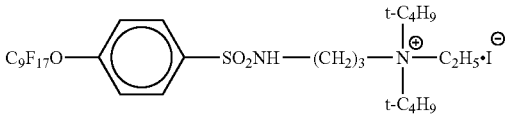

5)

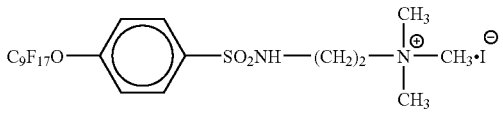

6)

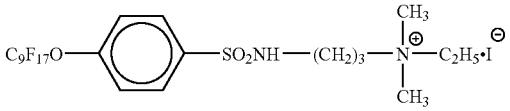

-continued
7)
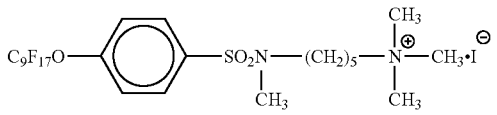
8)
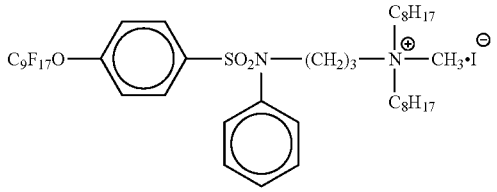
9)
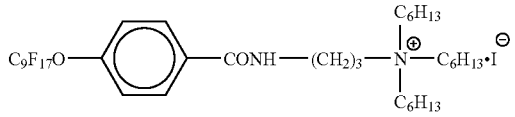
10)
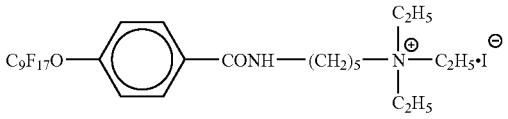
11)
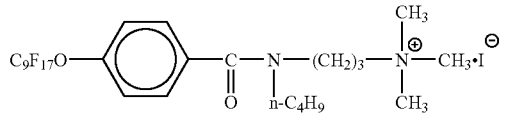
12)
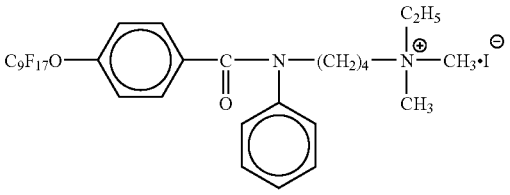
13)
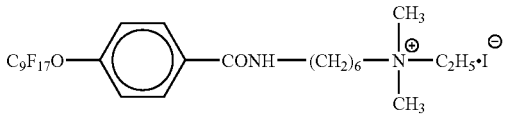
14)
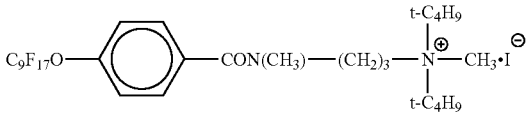
15)
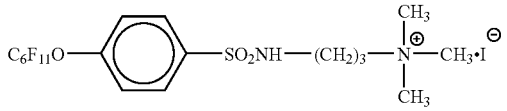
16)
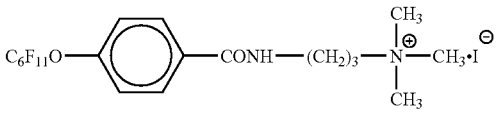
17)
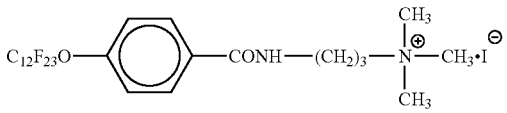
-continued
18)
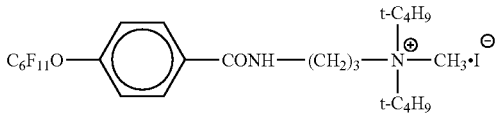
19)
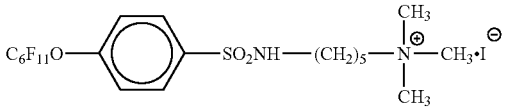
20)
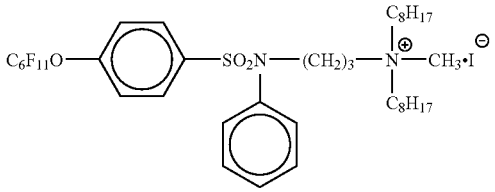
21)
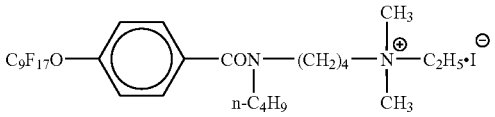
22)
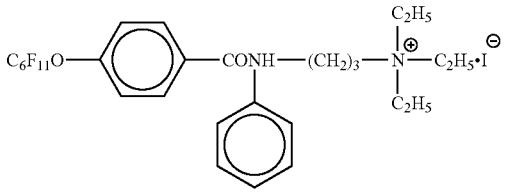
23)
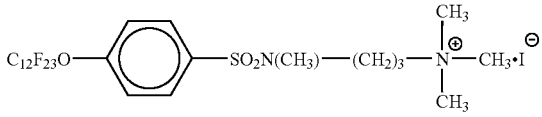
24)
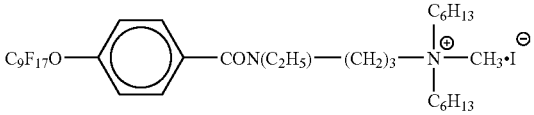
25)
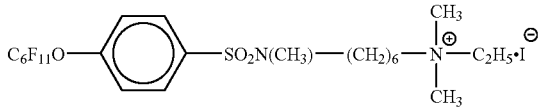
26)
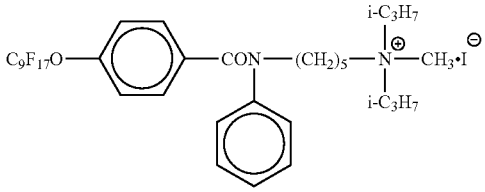
27)
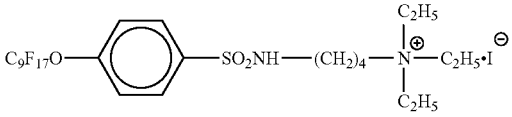

-continued
28)
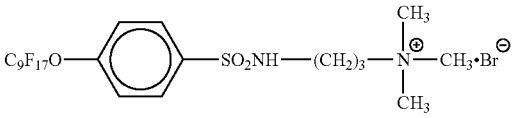
29)
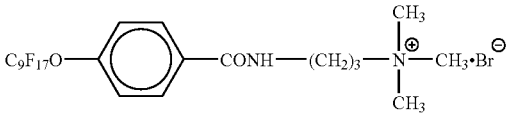
30)
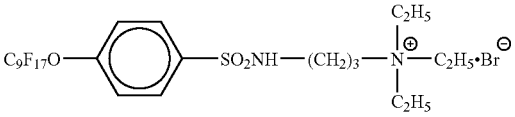
31)
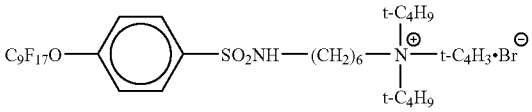
32)
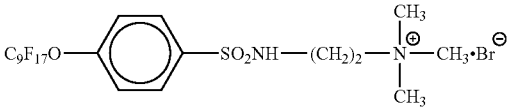
33)
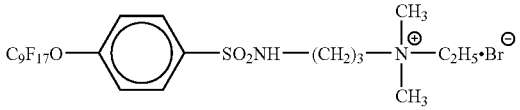
34)
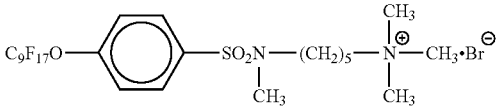
35)
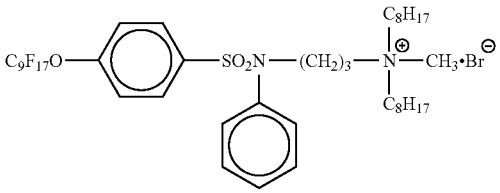
36)
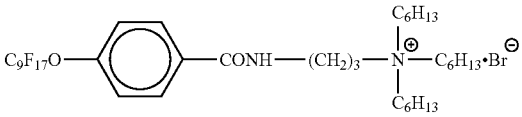
37)
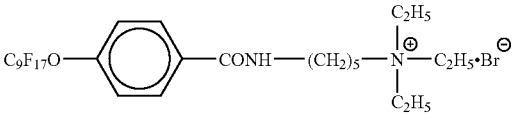
38)
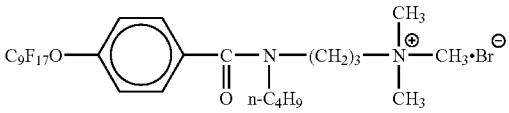
-continued
39)
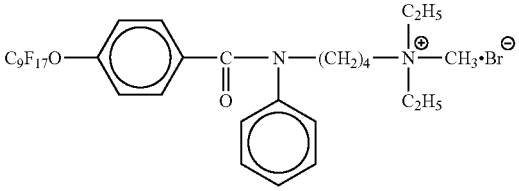
40)
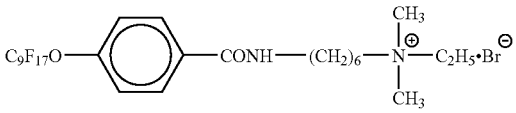
41)
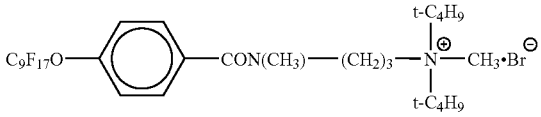
42)
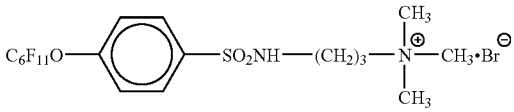
43)
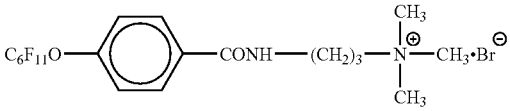
44)
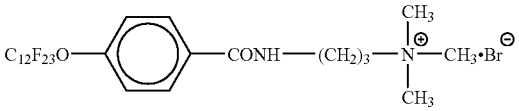
45)
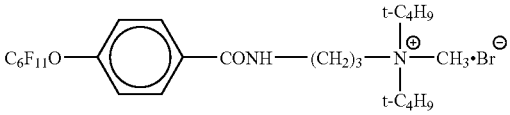
46)
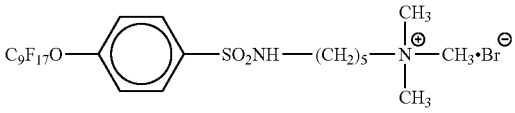
47)
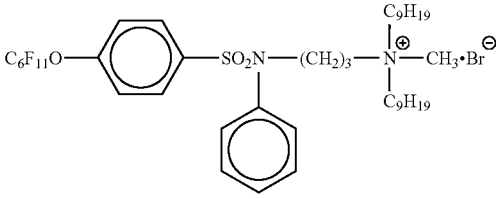
48)
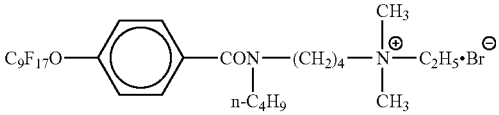

-continued

49)

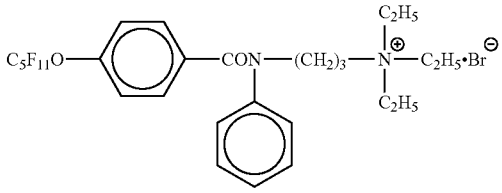

50)

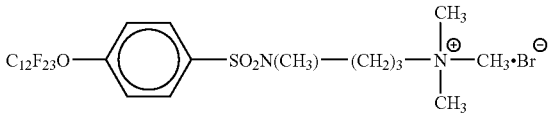

51)

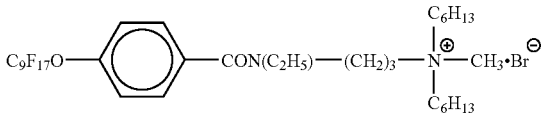

52)

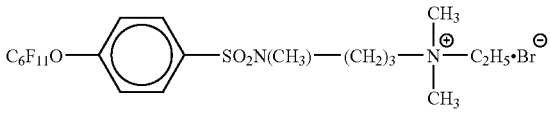

53)

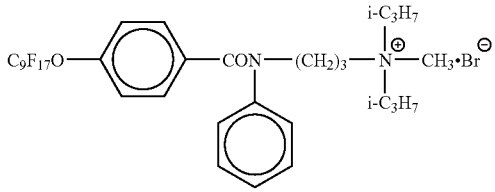

54)

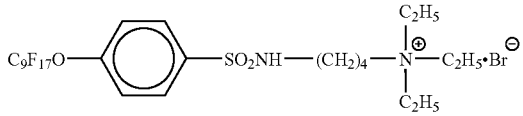

(Solid Fine Particle Dispersing Agent)

The solid fine particle dispersing agent is present as a water-poorly soluble solid in aqueous solvent and preferably as a fine particle of average particle diameter 0.01 through 1 μm.

As an inorganic fine particle, for example, provided are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride, etc.

More preferably, tricalcium phosphate, colloidal titanium oxide, colloidal silica, and hydroxyapatites, etc., can also be employed. Particularly, preferable is a hydroxyapatite synthesized by reacting sodium phosphate and calcium chloride under a basic condition in water.

Otherwise, as an organic solid fine particle dispersing agent, provided are microcrystals of a low-molecular weight organic compound and polymeric fine particles, for example, polymeric particles of copolymers of styrene and a monomer having a carboxyl group such as methacrylic acid, copolymers containing a methacrylic acid ester or an acrylic acid ester, condensation polymers such as silicone, benzoguanamine, and nylon, and thermosetting resins.

(A Compound Having an Isocyanate Group at Terminal Thereof; Prepolymer)

As a polyester prepolymer containing an isocyanate group (A), provided are prepolymers obtained by reacting a polyester being a condensation polymer of a polyol (1) and a polycarboxylic acid (2) and having an active hydrogen group with a polyisocyanate (3), etc. As the active hydrogen group of the polyester, provided are hydroxyl group (alcoholic hydroxyl group and phenolic hydroxyl group), amino group, carboxylic group, and mercapto group, etc., and among these groups the alcoholic hydroxyl group is preferable.

As a polyol (1), diols (1-1) and three or more hydroxyl groups-containing polyols are provided, and singularly used diols (1-1) or mixtures of a polyol (1-1) and a small amount of a three or more hydroxyl groups-containing polyol (1-2) are preferable.

As the diol (1-1), provided are alkylene glycols (such as ethylene glycol, 1,2-propylene glycol, 1,3-propylene glycol, 1,4-butanediol, and 1,6-hexanediol, etc.), alkylene ether glycols (such as diethylene glycol, triethylene glycol, dipropylene glycol, polyethylene glycol, polypropylene glycol, and poly(tetramethylene ether glycol, etc.), alicyclic diols (such as 1,4-cyclohexanedimethanol and hydrogenated bisphenol A, etc.), bisphenols (such as bisphenol A, bisphenol F, and bisphenol S, etc.), and alkylene oxide (such as ethylene oxide, propylene oxide, and butylene oxide, etc.) adducts of the alicyclic diol, and alkylene oxide (such as ethylene oxide, propylene oxide, and butylene oxide, etc.) adducts of the bisphenol, etc.

Among these, the alkylene glycols containing 2 through 12 carbons and the alkylene oxide adducts of a bisphenol are preferable, and the combination of the alkylene oxide adduct of a bisphenol and the alkylene glycol containing 2 through 12 carbons is particularly preferable.

As the three or more hydroxyl groups-containing polyol (1-2), provided are 3 through 8 or more hydric aliphatic alcohols (such as glycerin, trimethylolethane, trimethylolpropane, pentaerythritol, and soritol, etc.), three or more hydroxyl groups-containing phenols (such as trisphenol PA, phenolic novolac, and cresylic novolac, etc.), and alkylene oxide adducts of the three or more hydroxyl groups-containing polyphenol, etc.

As the polycarboxylic acid (2), dicarboxylic acids (2-1) and three or more carboxyl groups-containing carboxylic acids (2-2) are provided, and singularly used dicarboxylic acids (2-1) and mixtures of a dicarboxylic acid (2-1) and small amount of a three or more carboxyl groups-containing carboxylic acid (2-2) are preferable.

As the dicarboxylic acid (2-1), provided are alkylenedicarboxylic acids (such as succinic acid, adipic acid, and sebacic acid, etc.), alkenylenedicarboxylic acids (such as maleic acid and fumaric acid, etc.), and aromatic dicarboxylic acids (such as phthalic acid, isophthalic acid, terephthalic acid, and naphthalenedicaroxylic acid, etc.).

Among these, alkenylenedicaroxylic acids containing 4 through 20 carbons and aromatic dicarboxylic acids containing 8 through 20 carbons are preferable.

As the three or more carboxyl groups-containing carboxylic acid (2-2), aromatic polycarboxylic acids (such as trimellitic acid and pyromellitic acid, etc.), etc. are provided.

Additionally, instead of the polycarboxylic acid (2), anhydrides or lower-alkyl esters (such as methyl esters, ethyl esters, and isopropyl esters, etc.) thereof may be employed to react with the polyol (1).

Regarding the content ratio of the polyol (1) and the polycarboxylic acid (2), the equivalent ratio ([OH]/[COOH]) of hydroxyl groups [OH] to carboxyl groups [COOH] is commonly 2/1 through 1/1, preferably 1.5/1 through 1/1, more preferably 1.3/1 through 1.02/1.

As the polyisocyanate (3), provided are aliphatic polyisocyanates (such as tetramethylene diisocyanate, hexamethylene diisocyanate, and 2,6-diisocyanatomethylcaproate, etc.), alicyclic polyisocyanates (such as isophorone diisocyanate and cyclohexylmethane diisocyanata, etc.), aromatic diisocyanates (tolylene diisocyanate, diphenylmethane diisocyanate and α,α,α',α'-tetramethylxylylene diisocyanate, etc.), isocyanurates, polymers obtained by blocking the polyisocyanate with one of a phenol derivative, oxime, and caprolactam, etc., and the combinations of the polyisocyanates.

Regarding the content ratio of the polyisocyanate (3) and the polyester, the equivalent ratio ([NCO]/[OH]) of isocyanate groups [NCO] to hydroxyl groups [OH] contained in the polyester is commonly 5/1 through 1/1, preferably 4/1 through 1.2/1, more preferably 2.5/1 through 1.5/1. When the ratio [NCO]/[OH] is greater than 5, the fixing property of the toner at low temperature is lowered. When the ratio [NCO]/[OH] is less than 1, the content of urea groups in a modified polyester is lowered, and thereby the hot offset resistance of obtained toners is also lowered.

The content of polyisocyanate (3) components in the preploymer (A) containing an isocyanate group at the terminal thereof is commonly 0.5 through 40% by weight, preferably 1 through 30% by weight, more preferably 2 through 20% by weight. When the content is less than 0.5% by weight, the hot offset resistance of obtained toners is lowered and the simultaneous satisfaction of the heat resistance property for preservation of the obtained toners and the fixing property of the obtained toners at low temperature is difficult. When the content is greater than 40% by weight, the fixing property of obtained toners at low temperature is lowered.

The number of the isocyanate groups contained in 1 molecule of the prepolymer containing an isocyanate group (A) is commonly equal to or more than 1, preferably 1.5 through 3 on average, more preferably 1.8 through 2.5 on average. When the number of the isocyanate groups is less than 1 per 1 molecule of the prepolymer, the molecular weight of obtained urea-modified polyester is lowered, and thereby the hot offset property of obtained toners is also lowered.

As the amine (B), provided are diamines (B1), three or more amino groups containing polyamines (B2) aminoalcohols (B3), aminomercaptans (B4), amino acids (B5), compounds obtained by blocking an amino group in one of the amines B1 through B5 (B6), etc.

As the diamines (B1), provided are aromatic diamines (such as phenylenediamine, diethyltoluenediamine, and 4,4'-diaminodiphenylmethane, etc.), alicyclic diamines (such as 4,4'-diamino-3,3'-dimethyldicyclohexylmethane, diaminocyclohexane, and isophoronediamine, etc.), and aliphatic diamines (such as ethylenediamine, tetramethylenediamine, and hexamethylenediamine, etc.), etc.

As the three or more amino groups-containing polyamine (B2), diethylenetriamine and triethylenetetramine, etc., are provided. As the aminoalcohol (B3), ethanolamine and hydroxyethylaniline, etc., are provided. As the aminomercaptan (B4), aminoethylmercaptan and aminopropylmercaptan, etc., are provided. As the amino acid (B5), aminopropionic acid and aminocaproic acid, etc., are provided. As the compound obtained by blocking an amino group of B1 through B5, ketimine compounds and oxazoline compounds, etc., are provided, which are obtained from one of the amines B1 through B5 and one of ketones (such as acetone, ethyl methyl ketone, and isobutyl methyl ketone, etc.).

Among those amines (B), mixtures of the diamine (B1) and the small amount of the three or more amino groups-containing polyamine (B2) are preferable.

Furthermore, according to need, the molecular weight of the urea-modified polyester can be controlled using a propagation terminator. As the propagation terminator, provided are monoamines (such as diethylamine, dibutylamine, butylamine, and laurylamine, etc.) and compounds obtained by blocking the monoamine (that is, ketimine compounds), etc.

Regarding the content ratio of the amine (B) to the prepolymer containing an isocyanate group (A), the equivalent ratio [NCO]/[NHx] of the isocyanate group [NCO] in the prepolymer (A) to the amino group [NHx] of the amine (B) is commonly 1/2 through 2/1, preferably 1.5/1 through 1/1.5, more preferably 1.2/1 through 1/1.2. When the ratio [NCO]/[NHx] is greater than 2 or less than 1/2, the molecular weight of the urea-modified polyester is lowered, and thereby the hot offset resistance of obtained toners is lowered.

In the present invention, the urea linkage-modified polyester may contain a urethane linkage as well as an urea linkage. The molar ratio of the urea linkage to the urethane linkage is commonly 100/0 through 10/90, preferably 80/20 through 20/80, more preferably 60/40 through 30/70. When the molar ratio of the urea linkage to the urethane linkage is less than 10%, the hot offset resistance of obtained toners is lowered.

(Polyester Resin)

In the present invention, an unmodified polyester (C) may be used for a component of toner binder in addition to the prepolymer (A) and the amines (B). When the unmodified polyester (C) is used in combination, the fixing property of obtained toners and the luster of obtained toner images printed by a full-color image forming apparatus is improved. Thus, the combination use of the unmodified polyester (C) is more preferable than the no use of the unmodified polyester (C).

As the unmodified polyester (C), condensation polymers of the polyol (1) and the polycarboxylic acid (B), etc., are provided, similar to the polyester component of the prepolymer (A), and preferable unmodified polyester (C) is similar to the preferable polyester component of the prepolymer (A). Also, the polyester (C) may be not only unmodified polyester but also a polyester modified with a chemical bond except an urea linkage, for example, an urethane linkage-modified polyester.

Preferably, at least one portion of the unmodified polyester (C) is mutually soluble with the reactants of the prepolymer (A) and the amine (B) for improving the fixing property of obtained toners at low temperature and the hot offset resistance of the obtained toners. Accordingly, the unmodified polyester (C) has preferably a composition similar to the polyester component of the prepolymer (A). When the unmodified polyester (C) is combined, the weight ratio of the prepolymer (A) to the unmodified polyester (C) is commonly 5/95 through 80/20, preferably 5/95 through 30/70, more preferably 5/95 through 25/75, particularly preferably 7/93 through 20/80. When the weight ratio of the prepolymer (A) to the unmodified polyester (C) is less than 5%, the hot offset resistance of obtained toners is lowered and simultaneous satisfaction of the heat resistance property for preservation of the obtained toners and the fixing property of the obtained toners at low temperature is difficult.

The peak molecular weight of the unmodified polyester (C) is commonly 1,000 through 30,000, preferably 1,500 through 10,000, more preferably 2,000 through 8,000. When the peak molecular weight of the polyester (C) is less than 1,000, the heat resistance property for preservation of obtained toners is lowered. When the peak molecular weight of the unmodified polyester (C) is greater than 30,000, the fixing property of the obtained toners at low temperature is lowered. The hydroxyl value of the unmodified polyester (C) is preferably equal to or more than 5, more preferably 10 through 120, particularly 20 through 80. When the hydroxyl value is less than 5, simultaneous satisfaction of the heat resistance property for preservation of the obtained toners and the fixing property of the obtained toners at low temperature is difficult. The acid value of the unmodified polyester (C) is commonly 1 through 30, preferably 5 through 20. When the unmodified polyester (C) is acidic, the polyester (C) tends to be negatively charged.

In the present invention, the glass transition point of the toner binder is commonly 50 through 70° C., preferably 55 through 65° C. When the glass transition point is less than 50° C., the heat resistance property for preservation of the obtained toners is lowered. When the glass transition point is greater than 70° C., the fixing property of the obtained toners at low temperature is not enough. Since the urea-modified polyester resin that is a reaction product of the prepolymer (A) and the amine (B) is coexistent, dry-type toners according to the present invention tend to indicate good heat resistance for preservation compared to publicly-known polyester-based toners even if the glass transition point of the toner binder is low.

Regarding the storage modulus of the toner binder, such temperature (TG') that the storage modulus is 100 dyne/cm$^2$ at the measurement frequency of 20 Hz is commonly equal to or more than 100° C., preferably 110 through 200° C. When the temperature is less than 100° C., the hot offset resistance of obtained toners is lowered.

Regarding the viscosity of the toner binder, such temperature (Tη) that the viscosity is 1,000 poise at the measurement frequency of 20 Hz is commonly equal to or less than 180° C., preferably 90 thorough 160° C. When the temperature is greater than 180° C., the fixing property of obtained toners at low temperature is lowered. That is, TG' is preferably higher than Tη for simultaneously satisfying both the fixing property of the obtained toners at low temperature and the hot offset resistance of the obtained toners. In other words, the difference of TG' and Tη, that is, (TG'−Tη) is preferably equal to or more than 0° C., more preferably equal to or more than 10° C., particularly preferably equal to or more than 20° C. The upper limit of the difference is not particularly limited. Also, the difference of TG' and Tη is preferably 0 through 100° C., more preferably 10 through 90° C., particularly preferably 20 through 80° C., for simultaneously satisfying both the heat resistance property for preservation of the obtained toners and the fixing property of the obtained toners at low temperature.

(Coloring Agent)

For the coloring agent used in the present invention, all of the publicly known dyes and pigments can be used, which are, for example, carbon black, a nigrosine dye, iron black, naphthol yellow S, Hansa yellow (10G, 5G, G), cadmium yellow, yellow iron oxide, ocher, chrome yellow, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, anthrazane yellow BGL, isoindolinone yellow, red iron oxide, red lead oxide, lead vermilion, cadmium red, cadmium mercury red, antimony vermilion, permanent red 4R, para red, fire red, para-chloro-ortho-nitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmine 6B, pigment scarlet 3B, bordeaux 5B, toluidine maroon, permanent bordeaux F2K, helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perynone orange, oil orange, cobalt blue, Cerulean Blue, alkali blue lake, peacock blue lake, Victoria blue lake, no metal-containing phthalocyanine blue, phthalocyanine blue, fast sky blue, indanthrene blue (RS, BC), indigo, ultramarine blue, iron blue, anthraquinone blue, fast violet B, methyl violet lake, cobalt violet, manganese violet, dioxane violet, anthraquinone violet, chrome green, zinc green, chrome oxide, viridian, emerald green, pigment green B, naphthol green B, green gold, acid green lake, malachite green lake, phthalocyanine green, anthraquinone green, titanium oxide, zinc white, Litobon, and mixtures thereof.

The content of the coloring agent in toners is commonly 1 through 15% by weight, preferably 3 through 10% by weight.

The coloring agent employed in the present invention can be used as a master batch provided by mixing the coloring agent with a resin. As a binder resin used in manufacture of the master batch or kneaded with the master batch, provided are not only the aforementioned modified or unmodified polyester resin but also polymers of styrene or substituted styrene such as poly(styrene), poly(p-chlorostyrene), and poly(vinyltoluene), styrene-containing copolymers and styrene-containing terpolymers such as copoly(styrene/p-chlorostyrene), copoly(styrene/propylene), copoly(styrene/vinyltoluene), copoly(styrene/vinylnaphthalene), copoly(styrene/methyl acrylate), copoly(styrene/ethyl acrylate), copoly(styrene/butyl acrylate), copoly(styrene/octyl acrylate), copoly(styrene/methyl methacrylate), copoly(styrene/ethyl methacrylate), copoly(styrene/butyl methacrylate), copoly(styrene/methyl α-chloromethacrylate), copoly(styrene/acrylonitrile), copoly(styrene/methyl vinyl ketone), copoly(styrene/butadiene), copoly(styrene/isoprene), terpoly(styrene/acrylonitrile/indene), copoly(styrene/maleic acid), and copoly(styrene/maleic acid ester), poly(methyl methacrylate), poly(butyl methacrylate), poly(vinyl chloride), poly(vinyl acetate), poly(ethylene), poly(propylene), polyesters, epoxy resins, epoxy polyol resins, polyurethanes, polyamides, poly(vinyl butyral), poly(acrylic acid) resin, rosin, modified rosin, terpene resins, aliphatic or alicyclic hydrocarbon resins, aromatic petroleum resins, chlorinated paraffins, and paraffin waxes, etc., which are used alone or as a mixture thereof.

The master batch used in the present invention can be obtained by mixing and kneading a resin for the master batch and the coloring agent under the application of a strong shearing force. At this time, in order to emphasize the interaction between the coloring agent and the resin, an organic solvent may be used. Also, a method called flashing method is preferably used, which includes the steps of mixing and kneading an aqueous paste containing a coloring agent and water with a resin and an organic solvent to transfer the coloring agent to the side of the resin, and eliminating the water and organic solvent components, since a wet cake of the coloring agent can be used directly and a drying procedure is not required. For the mixing and kneading procedure, a strong shearing and dispersing apparatus such as a three-roll mill is preferably used.

(Release Agent)

Additionally, a wax as well as the toner binder and the coloring agent can be contained. For the wax in the present invention, publicly known waxes can be used. As the wax, provided are, for example, polyolefin (such as polyethylene wax and polypropylene wax, etc.), long chain hydrocarbons (such as paraffin wax and Sasol wax, etc.), and carbonyl group-containing waxes, etc. Among these, the carbonyl group-containing waxes are preferable.

As the carbonyl group-containing wax, provided are polyalkane-based carboxylic acid esters (such as carnauba wax, montan wax, trimetylolpropane tribehenate, pentaerythritoltetrabehenate, pentaerythritoldiacetatedibehenate, glycerintribehenate, and 1,18-octadecanedioldistearate, etc.), polyalkanolesters (such as tristearyl trimellitate and distearyl maleate, etc.), polyalkane-based amides (such as dibehenylamide of ethylenediamine, etc.), polyalkylamides (such as tristearyl amide of trimellitic acid, etc.) and dialkylketones (such as distearyl ketone, etc.), etc. Among these carbonyl group-containing waxes, polyalkane-based carboxylic acid esters are preferable.

The melting point of the wax used in the present invention is commonly 40 through 160° C., preferably 50 through 120° C., more preferably 60 through 90° C. When the wax has a melting point lower than 40° C., the heat resistance for preservation of obtained toners is lowered. When the wax has a melting point higher than 160° C., cold offset of obtained toners tends to occur at the time of fixing at low temperature. Also, the melt viscosity of the wax that is measured at temperature higher than the melting point by 20 C is preferably 5 through 1,000 cps, more preferably 10 through 100 cps. When the wax has the melt viscosity higher than 1,000 cps, the hot offset resistance of obtained toners and the fixing property of the obtained toners at low temperature are less improved. The content of the wax in the toners is commonly 0 through 40% by weight, preferably 3 through 30% by weight.

(Method of Manufacturing Dry-type Toners)

Dry-type toners can be manufactured by the following methods, but of course manufacturing is not limited to those methods.

Also, when a developer is prepared, in order to improve the fluidity, the storage life, the developing property, and the transfer property of the developer, inorganic fine particles such as the aforementioned hydrophobic silica fine particles, etc., may further be added to and mixed in the developer manufactured as described above. For mixing of an external additive, although a general mixer for powder is employed, the mixer is preferably equipped with a jacket, etc., such that the internal temperature of the mixer can be adjusted. For controlling the amount of load applied to the external additive, the external additive is added gradually. Of course, the number of revolutions, the rotational speed, the mixing time, and the temperature, etc., of the mixer may be changed. First heavy load and second light load or vice versa may be applied to the external additive.

As examples of usable mixers, provided are a V-type mixer, a locking mixer, Loedige Mixer, Nauter Mixer, and Henshel Mixer, etc.

In order to adjust the shape of an obtained toner particle further, provided are a method of mechanically adjusting the shape of a material by using a hybridizer and a mechanofusion, etc., which material is obtained by melting and kneading a toner material containing the toner binder and the coloring agent and subsequently milling the kneaded mixture, and a method called the spray-dry method of obtaining a spherical toner particle by dissolving or dispersing the toner material into a solvent, in which the toner binder is soluble, and subsequently eliminating the solvent using a spray-dry apparatus. Additionally, a method of making the toner particle to be spherical by heating the toner in an aqueous medium is also provided. However, the adjustment method of the toner particle shape is not limited to the aforementioned methods.

(External Additive)

As the external additive for aiding the fluidity, the developing property, and the electrostatic property of colored particles obtained according to the present invention, inorganic fine particles can be used. The primary particle diameter of the inorganic fine particles is preferably 5 nm through 2 μm, particularly preferably is 5 nm through 500 nm. Also, the specific surface area of the inorganic fine particle measured by the BET (Brunauer-Emmerit-Teller) method is preferably 20 through 500 $m^2/g$.

The content ratio of the inorganic fine particles to the toner is preferably 0.01 through 5% by weight, particularly preferably 0.01 through 2.0% by weight. As the material of the inorganic fine particles, provided are, for example, silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride, etc.

Otherwise, provided are polymeric fine particles formed from poly(styrene) and a copolymer of a methacrylic acid ester and an acrylic acid ester, which are obtained by soap-free emulsification polymerization, suspension polymerization, and dispersion polymerization, resins obtained by condensation polymerization such as silicone, benzoguanamine, and nylon, etc., and thermosetting resins.

Such fluidizer is subjected to surface treatment so as to enhance the hydrophobicity thereof, so that the fluidity and the electrostatic property of the toner are prevented from lowering even under high humidity condition. As a surface treating agent, provided are, for example, silane-coupling agents, silylation agents, silane-coupling agent containing a fluoroalkyl group, organic titanate-based coupling agents, silicone oil, and modified silicone oils, etc.

As a cleaning-effect enhancer for eliminating developers remaining on a photoconductor and/or a first transfer medium after a transfer process, provided are metal salts of a fatty acid such as zinc stearate, calcium stearate, and stearic acid, and polymer fine particles manufactured by the soap-free emulsification polymerization method, such as poly(methyl methacrylate) fine particles and poly(styrene) fine particles.

The polymer fine particles preferably have comparably narrow particle size distribution and the volume-averaged particle diameter of 0.01 through 1 μm.

(Carrier for Two-component Developer)

When the toner according to the present invention is used in a two-component developer, the toner is mixed with a magnetic carrier, and for the content ratio of the toner to the carriers in the developer, 10 parts by weight of the toners per 100 parts by weight of the carriers is preferable. As the magnetic carrier, used are conventionally publicly-known iron powder, ferrite powder, magnetite powder, and magnetic resin carrier, which have the particle diameter of approximately 20 through 200 μm.

Also, as a covering material for the magnetic carrier, provided are amino-based resins such as urea-formaldehyde resin, melamine resin, benzoguanamine resin, urea resin, polyamide resins, and epoxy resins, etc. Additionally, used are polyvinyl and polyvinylidene resins such as acrylic resin, poly(methyl methacrylate) resin, poly(acrylonitrile) resin, poly(vinyl acetate) resin, poly(vinyl alcohol) resin, poly(vinyl butyral) resin, polystyrene-based resin such as poly(styrene) resin and styrene-acryl copolymer resin, haloganated olefin resins such as poly(vinyl chloride), polyester resins such as poly(ethylene terephthalate) resin and poly (butylene terephthalate) resin, polycarbonate resin, poly (ethylene) resin, poly(vinyl fluoride) resin, poly(vinylidene fluoride) resin, poly(trifluoroethylene) resin, poly(hexafluoropropylene) resin, copolymer of vinylidene fluoride and an acryl monomer, copolymer of vinylidene fluoride and vinyl fluoride, fluorine-containing terpolymers such as terpolymer of tetrafluoroethylene, vinylidene, and no fluorine-containing monomer, and silicone resin, etc.

Additionally, according to need, electrically conductive powder may be contained in the covering resin. As the electrically conductive powder, used are metal powders, carbon black, titanium oxide, tin oxide, and zinc oxide, etc. These conductive powders have preferably the average particle diameter equal to or less than 1 μm. When the average particle diameter is larger than 1 μm, the control of the electrical resistance of the developer becomes difficult.

Also, the toner according to the present invention is used as a one-component magnetic toner that requires no carrier, and a non-magnetic toner.

According to the present invention, latent images for respective colors formed on a single photoconductor can be developed with developers according to the present invention that correspond to the respective colors, using a plurality of developing apparatuses with a developing roll and a developing blade for controlling the layer thickness of the developer provided on the developing roll to be uniform.

Also, latent images for respective colors formed on a single photoconductor can be developed with developers according to the present invention that correspond to the respective colors, using a plurality of developing apparatuses each with a developing roll and a developing blade for controlling the layer thickness of the developer provided on the developing roll to be uniform, and the developed images can be transferred to an intermediate transfer medium by the application of an electric field.

Additionally, latent images for respective colors separately formed on a plurality of photoconductors that correspond to developing apparatuses can be developed with developers according to the present invention that correspond to the respective colors, using a plurality of the developing apparatuses with a developing roll and a developing blade for controlling the layer thickness of the developer provided on the developing roll to be uniform.

Also, latent images for respective colors separately formed on a plurality of photoconductors that correspond to developing apparatuses can be developed with developers according to the present invention that correspond to the respective colors, using a plurality of the developing apparatuses with a developing roll and a developing blade for controlling the layer thickness of the developer provided on the developing roll to be uniform, and the developed images can be transferred to an intermediate transfer medium by the application of an electric field.

Furthermore, the present invention provides a process cartridge removable from a main body of an image forming apparatus, which includes as one unit at least one unit selected from the group including a latent image supporter (photoconductor), a charging unit for charging a surface of the latent image supporter, a packaging unit of packaging toners for electrophotography according to the present invention or developers containing the toners, a development unit for developing a latent image formed on the latent image supporter with the toners or the developers, and a cleaning unit for cleaning the developers remaining on the latent image supporter.

The present invention is explained with some embodiments more specifically, below. Herein, any of the notations of "part(s)" mean "part(s) by weight".

(Synthesis of Polyester Resin)

724 parts of an adduct containing 2 mol of bisphenol A ethyleneoxide, 276 parts of terephthalic acid, and 2 parts of dibutylethyleneoxide were thrown into a reactor with a cooling pipe, a stirrer, and a nitrogen-introducing pipe, reacted for 8 hours at the normal pressure and 230° C. to cause condensation polymerization, and further reacted for 5 hours at the reduced pressure of 10 through 15 mm Hg, so as to obtain unmodified polyester having the peak molecular weight of 4800. 100 parts of the resin were dissolved into and mixed in 100 parts of ethyl acetate so as to obtain a solution of a toner binder in ethyl acetate. One portion of the solution was dried under reduced pressure and the polyester resin was isolated. Tg of the obtained resin was 58° C. and the acid value of the obtained resin was 8.

EXAMPLE 1

200 parts of the solution of the polyester resin in ethyl acetate, 5 parts of carnauba wax, and 4 parts of copper phthalocyanine pigment were thrown into a pot to be shielded, and ball mill dispersion was performed for 24 hours using zirconia beads having the diameter of 5 mm, so as to obtain a toner composition. 600 parts of ion-exchanged water, 60 parts of tricalcium phosphate, and 3 parts of sodium dodecylbenzenesulfonate were thrown into a beaker, so as to perform uniform dissolution and dispersion. Then, the toner composition was added into the beaker and stirred for 3 minutes for emulsification, while the temperature inside the beaker was kept at 20° C. and stirring at 12000 rpm was performed using a TK Homo Mixer (available from Tokushu Kika Kogyo Co., Ltd.). Then, the liquid mixture was transferred to a flask with a stirring rod and a thermometer and solvent in the mixture was removed for 8 hours under the reduced pressure of 50 mm Hg and the temperature of 30° C. Gas chromatography indicated that the content of ethyl acetate in the dispersion system was equal to or less than 100 ppm. Then, the dispersed system was cooled to room temperature, 120 parts of 35% of concentrated hydrochloric acid was added to dissolve tricalcium phosphate. After stirring for 1 hour at room temperature, subsequently filtration was performed, a washing procedure was repeated three times such that a cake obtained by the filtration was re-dispersed into distilled water and filtered. The obtained cake was further re-dispersed into distilled water so that the solid content was 10% by weight. 1% by weight of the stearylammonium acetate aqueous solution was gradually added into the obtained dispersed system with stirring, so that the net content of stearylammonium acetate per the solid content of the toner was 0.3% by weight. After stirring for 1 hour at room temperature, subsequently filtration was performed, the obtained cake was dried for 24 hours at reduced pressure and the temperature of 40° C. so as to obtain base toner particles. Then, 0.5 parts of hydrophobic silica and 0.5 parts of hydrophobic titanium oxide were mixed with 100 parts of the base toner particles using a Henshel mixer so as to obtain toner according to the present invention.

(Comparison 1)

Comparison toner was obtained by procedures similar to example 1 except for use of an equal weight of distilled water instead of 1% by weight of the stearylammonium acetate aqueous solution used in example 1.

(Synthesis of Polyester Containing an Isocyanate Group at a Terminal Thereof)

724 parts of an adduct containing 2 mol of bisphenol A ethyleneoxide, 276 parts of isophthalic acid, and 2 parts of dibutylethyleneoxide were thrown into a reactor with a cooling pipe, a stirrer, and a nitrogen-introducing pipe, reacted for 8 hours at the normal pressure and 230° C., and further reacted for 5 hours at the reduced pressure of 10 through 15 mm Hg. Then, the obtained product was cooled to 160° C., 32 parts of phthalic anhydride were added to the obtained product and reacted with the cooled product for 2 hours. Then, the obtained product was cooled to 80° C. and reacted with 188 parts of isophoronediisocyanate for 2 hours so as to obtain an isocyanate-containing polymer.

(Synnthesis of Ketimine Compound)

170 parts of isophoronediamine and 75 parts of ethyl methyl ketone were thrown into a reactor in which a stirring rod and a thermometer were set, and reacted together for 5 hours at 50° C., to obtain a ketimine compound. The amine value of the ketimine compound was 418.

EXAMPLE 2

200 parts of the solution of the polyester resin in ethyl acetate, 5 parts of carnauba wax, and 4 parts of copper phthalocyanine pigment were thrown into a pot to be shielded, and ball mill dispersion was performed for 24 hours using zirconia beads having the diameter of 5 mm. Then, 20 parts of isocyanate-containing prepolymer expressed in the solid content equivalent were added, stirred, and mixed so as to obtain a toner composition. 600 parts of ion-exchanged water, 60 parts of tricalcium phosphate, and 3 parts of sodium dodecylbenzenesulfonate were thrown into a beaker, so as to perform uniform dissolution and dispersion. Then, an oil phase provided by mixing 1 part of the ketimine compound into the toner composition immediately before emulsification was prepared, thrown into the beaker, and stirred for 3 minutes for emulsification, while the temperature inside the beaker was kept at 20° C. and stirring at 12,000 rpm was performed using TK Homo Mixer (available from Tokushu Kika Kogyo Co., Ltd.). Then, the liquid mixture was transferred to a flask with a stirring rod and a thermometer and solvent in the mixture was removed for 8 hours under the reduced pressure of 50 mm Hg and the temperature of 30° C. Gas chromatography indicated that the content of ethyl acetate in the dispersion system was equal to or less than 100 ppm. Then, the dispersed system was cooled to room temperature, 120 parts of 35% of concentrated hydrochloric acid were added to dissolve tricalcium phosphate. After stirring for 1 hour at room temperature, subsequently filtration was performed, the washing procedure was repeated three times such that a cake obtained by the filtration was re-dispersed into distilled water and filtered. The obtained cake was further re-dispersed into distilled water so that the solid content was 10% by weight. 1% by weight of stearylammonium acetate aqueous solution was gradually added into the obtained dispersed system with stirring, so that the net content of the stearylammonium acetate per the solid content of the toner was 0.3% by weight. After stirring for 1 hour at room temperature, subsequently filtration was performed, the obtained cake was dried for 24 hours at reduced pressure and the temperature of 40° C. so as to obtain base toner particles. Then, 0.5 parts of hydrophobic silica and 0.5 parts of hydrophobic titanium oxide were mixed with 100 parts of the base toner particles using a Henshel mixer so as to obtain toner according to the present invention.

(Comparison 2)

Comparison toner was obtained by procedures similar to example 2 except for use of an equal weight of distilled water instead of 1% by weight of the stearylammonium acetate aqueous solution used in example 2.

EXAMPLE 3

Toner according to the present invention was obtained by procedures similar to example 2 except for use of 1% by weight of a cationic fluorine surface activating agent aqueous solution (available from Dainippon Ink and Chemicals, Inc.) instead of 1% by weight of the stearylammonium acetate aqueous solution used in example 2.

EXAMPLE 4

Toner according to the present invention was obtained by procedures similar to example 2 except for use of 1% by weight of aqueous solution of N,N,N-trimethyl-[3-(4-perfluorononenyloxybenzamide)propyl]ammonium being a compound represented by formula (1) and iodide product Ftergent 310 (available from Neos Co., Ltd.) instead of 1% by weight of the stearylammonium acetate aqueous solution used in example 2.

(Preparation of Dispersed System Containing Charge Control Agent)

10 parts of zinc di(tert-butyl)salicylate, 100 parts by weight of distilled water, and 1 part of sodium dodecylbenzenesulfonate were thrown into a pot to be shielded, and ball mill dispersion was performed for 24 hours using zirconia beads having the diameter of 5 mm so as to provide a dispersed system containing a charge control agent 1. All of the zinc di(tert-butyl)salicylate had the particle diameter equal to or less than 1 μm in the dispersed system.

EXAMPLE 5

200 parts of the solution of the polyester resin in ethyl acetate, 5 parts of carnauba wax, and 4 parts of copper phthalocyanine pigment were thrown into a pot to be shielded, and ball mill dispersion was performed for 24 hours using zirconia beads having the diameter of 5 mm. Then, 20 parts of isocyanate-containing prepolymer expressed in the solid content equivalent were added, stirred, and mixed so as to obtain a toner composition. 600 parts of ion-exchanged water, 60 parts of tricalcium phosphate, and 3 parts of sodium dodecylbenzenesulfonate were thrown into a beaker, so as to perform uniform dissolution and dispersion. Then, an oil phase provided by mixing 1 part of the ketimine compound into the toner composition immediately before emulsification was prepared, thrown into the beaker, and stirred for 3 minutes for emulsification, while the temperature inside the beaker was kept at 20° C. and stirring at 12,000 rpm was performed using TK Homo Mixer (available from Tokushu Kika Kogyo Co., Ltd.). Then, the liquid mixture was transferred to a flask with a stirring rod and a thermometer and solvent in the mixture was removed for 8 hours under the reduced pressure of 50 mm Hg and the temperature of 30° C. Gas chromatography indicated that the content of ethyl acetate in the dispersion system was equal to or less than 100 ppm. Then, the dispersed system was cooled to room temperature, 120 parts of 35% of concentrated hydrochloric acid were added to dissolve tricalcium phosphate. After stirring for 1 hour at room temperature, subsequently filtration was performed, washing procedure was repeated three times such that a cake obtained by the filtration was re-dispersed into distilled water and filtered. The obtained cake was further re-dispersed into distilled water so that the solid content was 10% by weight. The dispersed system containing a charge control agent 1 was gradually added into the obtained dispersed system with stirring, so that the net content of the zinc di(tert-butyl) salicylate per the solid content of the toner was 1% by weight. Additionally, 1% by weight of Ftergent 310 (available from Neos Co., Ltd.) aqueous solution was gradually added into the obtained dispersed system, so that the net content of the FT 310 per the solid content of the toner was 0.3% by weight. After stirring for 1 hour at the liquid temperature of 60° C., subsequently cooling to room temperature and filtration were performed, and the obtained cake was dried for 24 hours at reduced pressure and the temperature of 40° C. so as to obtain base toner particles. Then, 0.5 parts of hydrophobic silica and 0.5 parts of hydrophobic titanium oxide were mixed with 100 parts of the base toner particles using a Henshel mixer so as to obtain toner according to the present invention.

10 parts of calixarene polymer F21 (available from Orient Chemical Industries, Ltd.), 100 parts of distilled water, and 1 part of sodium dodecylbenzenesulfonate were thrown into a pot to be shielded, and ball mill dispersion was performed for 24 hours using zirconia beads having the diameter of 5 mmϕ, so as to obtain the dispersed system containing a charge control agent 1. All of the calixarene polymer had particle diameters equal to or less than 1 μm in the dispersed system.

EXAMPLE 6

Toner according to the present invention was obtained by procedures similar to example 5 except for use of an equal weight of the dispersed system 2 containing a charge control agent instead of the dispersed system containing a charge control agent 1 used in example 5.

(Synthesis of Resin Fine Particles)

683 parts of water, 11 parts of a salt of sodium methacrylic acid ethyleneoxide adduct sulfate (Eleminol RS-30, available from Sanyo Chemical Industries, Ltd.), 138 parts of styrene, 83 parts of methacrylic acid, 55 parts of tetrafluoroetyl methcarylate, and 1 part of ammonium persulfate were thrown into a reactor with a stirring rod and a thermometer, and stirring was performed for 15 minutes at 400 rotations per minute, so as to obtain a white emulsion. The white emulsion was heated so that the temperature inside the reaction system was elevated and reaction occurred for 5 hours. 30 parts of 1% of ammonium persulfate aqueous solution were added into the emulsion and the emulsion was heated for 5 hours at the temperature of 75° C., so as to an aqueous dispersed system containing a vinyl resin (quaterpolymer of styrene-methacrylic acid-tetrafluoroethyl methacrylate-salt of sodium methacrylic acid ethyleneoxide adduct sulfate). The volume-averaged particle diameter of fine particles determined by measuring the obtained dispersed system containing the fine particles using a particle size distribution analyzer LA-920 (available from Horiba, Ltd.) was 0.25 μm.

EXAMPLE 7

Toner according to the present invention was obtained by procedures similar to example 5 except for gradually adding the synthesized dispersed system containing resin fine particles so that the solid content of the resin fine particles in the dispersed system to the solid content of the toner was 1.0% by weight, instead of the dispersed system containing a charge control agent 1 used in example 5.

(Evaluation of the Obtained Toners)

5 parts of manufactured color toners and 95 parts by weight of carriers described below were mixed for 10 minutes using a blender to manufacture developers. The evaluation results of the developers are shown in Table 1.

TABLE 1

| No | INITIAL CHARGE QUANTITY | SATURATED CHARGE QUANTITY | (HH) SATURATED CHARGE QUANTITY | THIN LINES REPRODUCIBILITY | FIXING TEMPERATURE RANGE |
|---|---|---|---|---|---|
| EXAMPLE 1 | −5.0 | −22.5 | −11.3 | Δ | 30 |
| EXAMPLE 2 | −6.2 | −20.8 | −8.5 | ○ | 80 |
| EXAMPLE 3 | −28.5 | −26.3 | −14.6 | ○ | 75 |
| EXAMPLE 4 | −31.5 | −28.5 | −21.2 | ○ | 85 |
| EXAMPLE 5 | −35.2 | −33.8 | −34.2 | ◎ | 80 |
| EXAMPLE 6 | −32.5 | −28.9 | −30.1 | ◎ | 80 |
| EXAMPLE 7 | −29.5 | −31.2 | −32.2 | ◎ | 90 |
| COMPARISON 1 | +10.5 | +35.2 | +0.3 | X | 10 |
| COMPARISON 2 | +3.2 | +50.5 | +0.2 | X | 75 |

(Carrier)

Core material: Spherical ferrite particles having an average diameter of 50 μm

Component material of coating agent: Silicone resin in which an aminosilane-based coupling agent was dispersed The aminosilane-based coupling agent and the silicone resin were dispersed into toluene. After the liquid dispersed system was prepared, the dispersed system was spray-coated, baked, and cooled, so as to manufacture carrier particles having the average film thickness of the coat resin of 0.2 μm.

(Initial Charge Quantity)

In a test room at the temperature of 20° C. and the humidity of 50%, 100 parts of the carrier and 5 parts of the toner according to the present invention were thrown into a stainless pot and rotated and mixed at a constant number of revolutions on a mount of a ball mill. After the rotation was stopped at 15 minutes from the start of the rotation, the charge quantities (μC/g) of the obtained developers were measured using a blow off apparatus.

(Saturated Charge Quantity)

With operations similar to the operation for the measurement of the initial charge, the charge quantities (μC/g) of the developers after the aforementioned stirring for 10 minutes were measured using the blow off apparatus.

(Saturated Charge Quantity Under High Temperature and High Humidity (HH))

In a test room with the conditions of the temperature of 30° C. and the humidity of 90° C., 100 parts of the carriers and 5 parts of the toners according to the present invention were left to stand for 1 hour, thrown into a stainless pot, and rotated and mixed at a constant number of revolution on a mount of ball mill. The charge quantities of the developers obtained after the aforementioned stirring for 10 minutes were measured using the blow off apparatus.

(Thin Lines Reproducibility)

For evaluating thin line reproducibilty regarding the developers according to the present invention, the developers were thrown into a modified machine of a tandem—intermediate transfer—type commercial color copying machine (Imagio color 5,000 available from Ricoh Co., Ltd.), in which a unit for fixing oil was removed, and running at the condition of the printing rate (the image population rate) of 7% was performed using 6,000 papers available from Ricoh Co., Ltd. Then, thin lines of the 30,000th image and thin lines of the initial 10th image were compared with an original copy. Also, thin lines were observed using an optical microscope at the magnification of 100, and the degrees of lack of thin lines of the 10th and 30,000th images were compared with the degrees of lack of the thin lines of stage samples and evaluated on the basis of 4 stages of the samples. In all of the examples and the comparisons, image quality is higher to lower in the order of

◎>○>Δ>X

Particularly, the evaluation of "X" means the level on which the developers could not be adopted as a product.

(Fixing Temperature Range)

The fixing properties were evaluated by running 30,000 papers similar to the evaluation of thin lines reproducibility, subsequently outputting an image colored all over the surface thereof with the variation of the temperature of a fixing roller ranging from 120 through 200° C., transferring toners for forming the image to a tape, and comparing the degree of the adhesion of dirt with four stages of stage samples. The fixing temperature at which the dirt of the tape was equal to or less than the standard for dirt was designated as the lower limit of the fixing temperature, the fixing temperature at which the luster of the image started to decrease due to hot offset was designated as the upper limit of the fixing temperature, and the difference between the upper limit and the lower limit was designated as the fixing temperature range.

As indicated in the test results described above, the treatment with a surface active agent having an opposite polarity or the combination of a particular surface active agent and a charge control agent can provide an excellent electrostatic property to the toner or developer. Also, an excellent image quality and an excellent fixing property can be obtained.

Additionally, a development method, a transfer method, and a process cartridge for providing an image with an excellent image quality by using the toners or developers according to the present invention can be provided.

The present invention is not limited to the specifically disclosed embodiments, and variations and modifications may be made without departing from the scope of the present invention.

The present application is based on Japanese priority application No.2002-214493 filed on Jul. 23, 2002, the entire contents of which are hereby incorporated by reference.

What is claimed is:

1. A toner for electrophotography obtained by a method comprising dissolving or dispersing a toner composition comprising a resin and a coloring agent into polymerizable monomers to provide a solution or a dispersed system, emulsifying the solution or the dispersed system with a first surface active agent in an aqueous medium to provide an emulsion, and polymerizing the polymerizable monomers in the emulsion to obtain toner, wherein a second surface active agent having polarity opposite to polarity of the first surface active agent is added after the emulsifying step, and wherein the second surface active agent is adsorbed on a surface of a particle of the toner.

2. A toner for electrophotography obtained by a method comprising dispersing a toner composition comprising a resin and a coloring agent into an aqueous medium to provide a dispersed system, aggregating the dispersed system in an aqueous medium containing a first surface active agent to provide an aggregate, and fusing the aggregate by heating to obtain toner, wherein a second surface active agent having polarity opposite to polarity of the first surface active agent is added after the fusing step, and wherein the second surface active agent is adsorbed on a surface of a particle of the toner.

3. A toner for electrophotography obtained by a method comprising dissolving or dispersing a toner composition comprising a resin and a coloring agent into an organic solvent to provide a solution or a dispersed system, emulsifying the solution or the dispersed system with a first surface active agent in an aqueous medium to provide an emulsion, and eliminating the organic solvent from the emulsion to obtain toner, wherein a second surface active agent having polarity opposite to polarity of the first surface active agent is added after the emulsifying step, and wherein the second surface active agent is adsorbed on a surface of a particle of the toner.

4. A toner for electrophotography obtained by a method comprising dissolving or dispersing a toner composition comprising a resin, a coloring agent, and polymerizable monomers into an organic solvent to provide a solution or a dispersed system, emulsifying the solution or the dispersed system with a first surface active agent in an aqueous medium to provide an emulsion, polymerizing the polymerizable monomers in the emulsion to obtain a polymer liquid, and eliminating the organic solvent from the polymer liquid to obtain toner, wherein a second surface active agent having polarity opposite to polarity of the first surface active agent is added after the emulsifying step, and wherein the second surface active agent is adsorbed on a surface of a particle of the toner.

5. A developer for electrophotography comprising a toner as claimed in claim 1, and a carrier for carrying the toner.

6. A developer for electrophotography comprising a toner as claimed in claim 2, and a carrier for carrying the toner.

7. A developer for electrophotography comprising a toner as claimed in claim 3, and a carrier for carrying the toner.

8. A developer for electrophotography comprising a toner as claimed in claim 4, and a carrier for carrying the toner.

9. A process cartridge removable from a main body of an image forming apparatus, comprising as one unit at least one of a latent image supporter, a charging unit charging a surface of the latent image supporter, a packaging unit packaging the toner for electrophotography as claimed in claim 1, a development unit developing a latent image formed on the latent image supporter with the toner, and a cleaning unit cleaning the toner remaining on the latent image supporter.

10. A process cartridge removable from a main body of an image forming apparatus, comprising as one unit at least one of a latent image supporter, a charging unit charging a surface of the latent image supporter, a packaging unit packaging the toner for electrophotography as claimed in claim 2, a development unit developing a latent image formed on the latent image supporter with the toner, and a cleaning unit cleaning the toner remaining on the latent image supporter.

11. A process cartridge removable from a main body of an image forming apparatus, comprising as one unit at least one of a latent image supporter, a charging unit charging a surface of the latent image supporter, a packaging unit packaging the toner for electrophotography as claimed in claim 3, a development unit developing a latent image formed on the latent image supporter with the toner, and a cleaning unit cleaning the toner remaining on the latent image supporter.

12. A process cartridge removable from a main body of an image forming apparatus, comprising as one unit at least one of a latent image supporter, a charging unit charging a surface of the latent image supporter, a packaging unit packaging the toner for electrophotography as claimed in claim 4, a development unit developing a latent image formed on the latent image supporter with the toner, and a cleaning unit cleaning the toner remaining on the latent image supporter.

13. A process cartridge removable from a main body of an image forming apparatus, comprising as one unit at least one of a latent image supporter, a charging unit charging a surface of the latent image supporter, a packaging unit packaging the developer for electrophotography as claimed in claim 5, a development unit developing a latent image formed on the latent image supporter with the developer, and a cleaning unit cleaning the developer remaining on the latent image supporter.

14. A process cartridge removable from a main body of an image forming apparatus, comprising as one unit at least one of a latent image supporter, a charging unit charging a surface of the latent image supporter, a packaging unit packaging the developer for electrophotography as claimed in claim 6, a development unit developing a latent image formed on the latent image supporter with the developer, and a cleaning unit cleaning the developer remaining on the latent image supporter.

15. A process cartridge removable from a main body of an image forming apparatus, comprising as one unit at least one of a latent image supporter, a charging unit charging a surface of the latent image supporter, a packaging unit packaging the developer for electrophotography as claimed in claim 7, a development unit developing a latent image formed on the latent image supporter with the developer, and a cleaning unit cleaning the developer remaining on the latent image supporter.

16. A process cartridge removable from a main body of an image forming apparatus, comprising as one unit at least one of a latent image supporter, a charging unit charging a surface of the latent image supporter, a packaging unit packaging the developer for electrophotography as claimed in claim 8, a development unit developing a latent image formed on the latent image supporter with the developer, and a cleaning unit cleaning the developer remaining on the latent image supporter.

* * * * *